US009269370B2

(12) United States Patent
Herberger et al.

(10) Patent No.: US 9,269,370 B2
(45) Date of Patent: Feb. 23, 2016

(54) ADAPTIVE SPEECH FILTER FOR ATTENUATION OF AMBIENT NOISE

(71) Applicant: MAGIX AG, Berlin (DE)

(72) Inventors: Tilman Herberger, Dresden (DE); Titus Tost, Dresden (DE); Georg Flemming, Dresden (DE)

(73) Assignee: MAGIX AG (DE)

( * ) Notice: Subject to any disclaimer, the term of this patent is extended or adjusted under 35 U.S.C. 154(b) by 0 days.

(21) Appl. No.: 14/569,134

(22) Filed: Dec. 12, 2014

(65) Prior Publication Data

US 2015/0187367 A1 Jul. 2, 2015

Related U.S. Application Data

(60) Provisional application No. 61/915,305, filed on Dec. 12, 2013.

(51) Int. Cl.
*G10L 21/02* (2013.01)
*G10L 21/0208* (2013.01)

(52) U.S. Cl.
CPC ..... *G10L 21/0208* (2013.01); *G10L 21/02* (2013.01)

(58) Field of Classification Search
CPC ..... G10L 21/02; G10L 21/0208; G10L 21/02085
See application file for complete search history.

(56) References Cited

U.S. PATENT DOCUMENTS

| | | | | |
|---|---|---|---|---|
| 7,317,801 | B1 * | 1/2008 | Amir | G10K 11/1782 379/406.05 |
| 2005/0276363 | A1 * | 12/2005 | Joublin | 375/350 |
| 2009/0177466 | A1 * | 7/2009 | Rui | G10L 21/0208 704/225 |
| 2010/0063807 | A1 * | 3/2010 | Archibald | G10L 21/0208 704/226 |
| 2010/0161324 | A1 * | 6/2010 | Tanaka | G10K 11/178 704/226 |
| 2010/0179808 | A1 * | 7/2010 | Brown | G10L 21/0208 704/225 |
| 2015/0066499 | A1 * | 3/2015 | Wang | G10L 25/30 704/233 |
| 2015/0187367 | A1 * | 7/2015 | Herberger | G10L 21/0208 704/226 |

* cited by examiner

*Primary Examiner* — Samuel G Neway
(74) *Attorney, Agent, or Firm* — Fellers, Snider, Blakenship, Bailey & Tippens P.C.; Terry L. Watt

(57) ABSTRACT

According to a preferred aspect of the instant invention, there is provided a system and method that allows the user to attenuate ambient noise in speech recordings in the audio part of a video recording. The user does not need to define particular sections or samples or individual parameters. The system is automatically analyzing the input signal and in a plurality of individual steps detects the ambient noise, determines an adaptive filter, implements the filter and therewith attenuates the ambient noise accordingly.

1 Claim, 3 Drawing Sheets

ADAPTIVE SPEECH FILTER FOR ATTENUATION OF AMBIENT NOISE

This application claims the benefit of U.S. Provisional Patent Application Ser. No. 61/915,305 filed on Dec. 12, 2013, and incorporates said provisional application by reference into this document as if fully set out at this point.

FIELD OF THE INVENTION

The present invention relates to the general subject matter of creating and analyzing video works and, more specifically, to systems and methods of attenuating ambient noise in a video work.

BACKGROUND

Removal of ambient noise from video recordings is an area in which many different approaches exist. A common theme, though, is that all such approaches seek to be the most effective without harming the integrity of the input signal.

Many current methods of attenuating or removing ambient noise in video recordings at utilize the principle of "spectral subtraction". In this approach the unwanted component of the signal is estimated and afterwards subtracted from the signal, with the portion of the signal that remains after subtraction presumably being the desired signal.

The undesirable component of the signal is might be either automatically determined using a targeted search in the signal for sequences that do not contain speech to use in estimating the undesirable components, or in other cases the user might have to manually select a noise sample (e.g., a section of the sample that contains only the undesirable/background component). The latter approach is the most common approach in software based solutions.

Other approaches for attenuation of ambient noise known in the art (for example "beam forming" or "active noise suppression") require a number of simultaneously recorded input signals from differently positioned microphones.

The many different approaches are due ion part to the ultimate goal of the noise reduction effort. For example, different methods might be utilized in hearing aids, telephones and intercom systems that process band limited speech signals. For these sorts of devices, a central goal might be to increase the understandability audibility of speech in general.

Background noise that is too loud is a common side effect when utilizing semi-professional equipment for video recording. One reason for this is because of the microphones that are integrated into the recording video cameras that are typically used. In the professional sector however external microphones are utilized which are normally located near or around the current speaker. That significantly minimizes the chances that there will be a problem with the volume of the ambient noise compared to the volume of the speech.

Known methods to reduce ambient noise in hearing aids, intercoms and telephones also usually have to deal with the limitations regarding computing capacity, real-time capacity (low latency) and memory requirements.

The methods which are already state of the art usually work exclusively in the frequency domain or the time domain. The instant invention utilizes a mixed approach, wherein the digital signal is separated into single spectral components. These frequency components are than transformed back into the time domain, in which the analysis takes place. The instant invention is therefore a method which operates in the frequency domain as well as in the time domain.

Thus, what is needed is a system and method for computer devices that supports a user when attenuating random ambient noise, including wind noise in video recordings with speech content, wherein the system is directly usable as a software module in video and/or audio editing software.

Heretofore, as is well known in the media editing industry, there has been a need for an invention to address and solve the above-described problems. Accordingly it should now be recognized, as was recognized by the present inventors, that there exists, and has existed for some time, a very real need for a system and method that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of the invention within the ambit of the appended claims.

SUMMARY OF THE INVENTION

There is provided herein a system and method for an adaptive speech filter for attenuation of ambient noise in speech recordings of video material.

In a preferred embodiment, the instant invention will comprise two separate processes that when combined provide the full functionality of the adaptive speech filter. An embodiment preferably does not require continuous user interaction. An embodiment of a graphical user interface that provides access to the inventive functionality might take many forms.

An embodiment of the instant invention preferably starts with the analysis of the input signal. In a first preferred step the input signal is broken down into the spectral components with the most energy. This breakdown of the input signal is carried out with a recursive spectral analysis of maxima and minima. The detected spectral components with the most energy are then, in a next preferred step, further analyzed to determine their affiliation to harmonic banks.

In a next preferred step the behavior of the zero points in the time domain signals of the spectral components with the most energy is analyzed. In the last step of the analysis part of the instant invention the filter curve (frequency response) of the adaptive speech filter is calculated. The instant invention utilizes for this calculation the analysis results of the components with the most energy and the analysis results of the zero points.

With the generation of the adaptive speech filter curve the instant invention initiates the second part, the second process, which is the implementation of the adaptive speech filter. In a first preferred step the signal is filtered in the frequency range with an additional filter smoothing in the frequency range. The instant invention further provides pre- and post ringing filters to minimize undesired side effects of the adaptive speech filtering.

By way of a high level summary, an embodiment of the invention will work as follows. A first component of the invention involves an analysis of the input signal and generation of an adaptive speech filter. According to an embodiment of this component, (1) the input signal will be analyzed to identify the spectral components of the signal with the most energy. In an embodiment, this will be done via a recursive spectral analysis that is adapted to find frequencies associated with maxima and minima. The spectral components with the most energy will then be used to (2) determine their association with a harmonic series. Next, there will be an analysis of the zero (null) point(s) in the time domain of the spectral components with the most energy determined previously. One embodiment of the invention will determine the gradient of the spectrum at each of the zero point positions. The variance of each gradient will then be used to help differentiate noise from speech.

More particularly, according to the current embodiment the variance of each gradient will be used to differentiate the blocks into either a noise or non-noise category. More particularly, in an embodiment if the variance is relatively "high" the associated block will be assigned to a "noise" category. If the variance is intermediate in value, that block will be determined to be mostly speech. Finally, if the variance is relatively "low", that block will be determined to be non-noise but most likely not associated with speech.

Next a transfer function of an adaptive speech filter will be calculated using the results of (1) and (2). Note that when the terms "zero" and/or "zero point" (in German "nullstelle") are used herein, those terms should be broadly construed to include instances where the "zero point" is actually a very small value not exactly equal to zero.

Next, the adaptive filter will be applied, preferably in the frequency domain, and in some embodiments additional smoothing will be applied. Additionally, pre- and post-application of the speech filter an anti-ringing filter might be applied to minimize the noise associated therewith. These filters would typically be applied in the frequency domain, followed potentially by some additional smoothing applied to the filtered signal.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

BRIEF DESCRIPTION OF THE DRAWINGS

Other objects and advantages of the invention will become apparent upon reading the following detailed description and upon reference to the drawings in which.

DESCRIPTION

Figure 1:
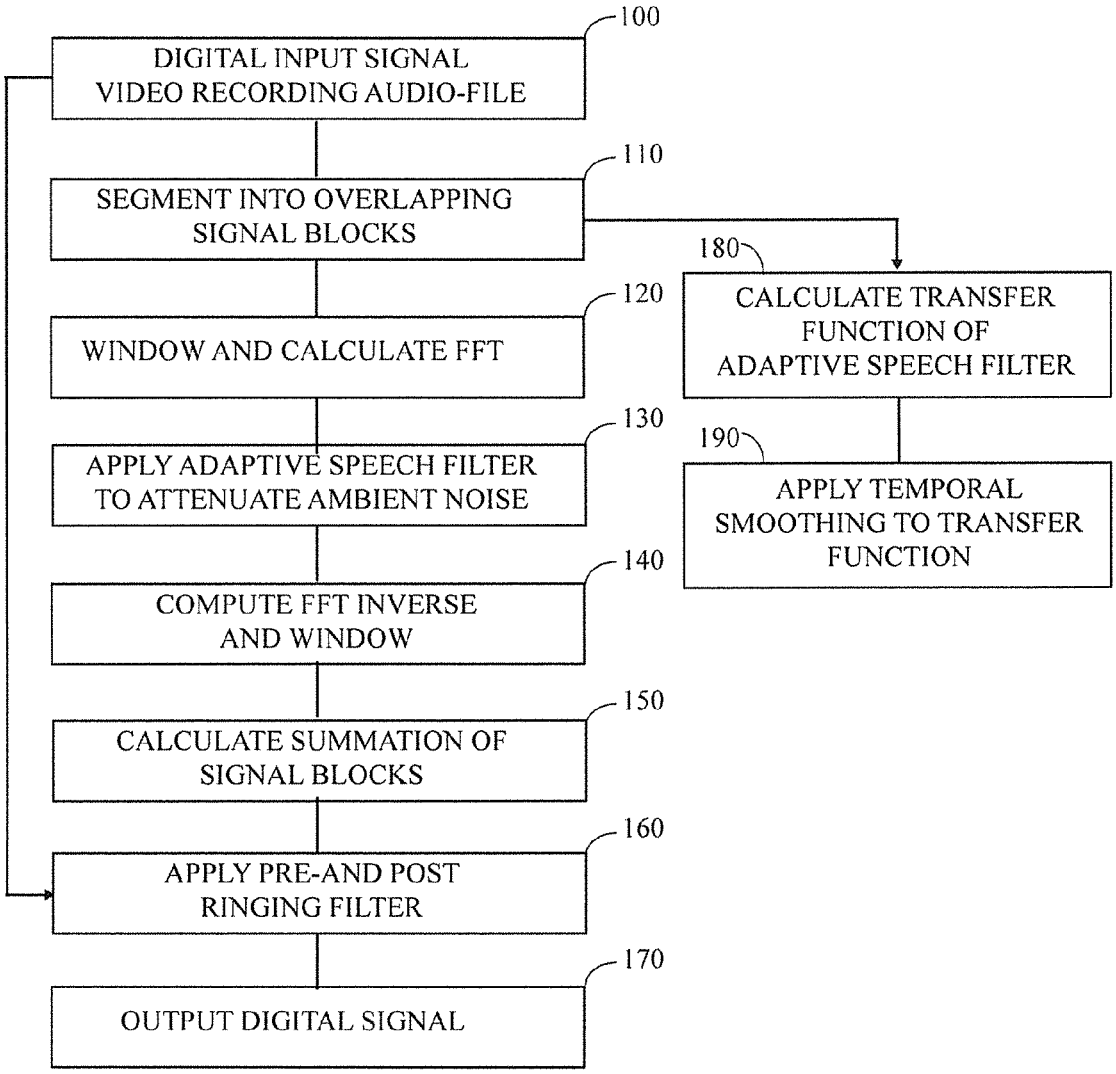
FIG. 1 depicts an embodiment of the individual processes of the adaptive speech filter

Referring now to the drawings, wherein like reference numerals indicate the same parts throughout the several views, there is provided a preferred system and method for an adaptive speech filter for attenuation of ambient noise in speech recordings of video material.

Turning first to FIG. 1, an embodiment of the present invention preferably begins with the input of a digital signal into a personal or other computer with the input signal being the audio part of a video recording 100. Of course, although a personal computer would be suitable for use with an embodiment, in reality any computer (including a table, phone, etc.) could possibly be used if the computational power were sufficient.

Next the input signal will be divided into overlapping segments/blocks 110. In some embodiments, the audio data might be sampled at a rate of 44 kHz, although other samples rates are certainly possible. That being said, the sample rate and the length of the audio clip will depend on the rate at which the audio was recorded and the length of the recording, whatever that might be. According to some embodiments, the block length might be a few hundred to several thousand samples in (e.g., 4096 samples) depending on the sample rates. The amount of overlap might be between 0% and 25% of the block size in some embodiments.

Next, in a preferred step and according to the embodiment of FIG. 1, the windowed input signal will be Fourier transformed using a Fast Fourier transform ("FFT") to transform the audio data into the frequency domain 120. That being said, those of ordinary skill in the art will recognize that although the FFT is a preferred method of transforming the data to the frequency domain, a standard Fourier transform could be calculated instead. Additionally, there are any number of other transforms that could be used instead. As one specific example, the Walsh transform and various wavelet-type transforms (preferably with orthogonal basis functions) are known to convert data into a domain where different characteristics of the input signal can be separated and analyzed.

Continuing with the present example, the instant invention will calculate the transfer function of the adaptive speech filter 180, preferably in conjunction with the time the input signal is divided into overlapping blocks and windowed and transformed with an FFT 120. The signal is analyzed with a goal of determining the spectral components with the most energy. This is achieved with the recursive maxima-minima analysis. The spectral components so determined are then analyzed in terms of their harmonic series properties (e.g., if the spectral components belong to a harmonic series, the frequencies with the highest spectral maxima would be multiple of the base frequency) and then root/null/nullstelle is determined for each spectral component in order to classify it. With the results from a) the analysis in terms of harmonic series and b) the root/null point/nullstelle analysis, the curve of the filter function is determined.

To help guard against an erroneous speech detection—which could manifest itself as strong irregularities within the sound of the adaptive speech filter—the calculated transfer function in some embodiments will be subjected to a temporal equalization 190, e.g., it might be normalized to have unit magnitude, etc. The time constants for that temporal equalization could be, depending of drop or rise, defined separately.

Continuing with the present embodiment, the calculated adaptive speech filter function will then be multiplied times the input signal in the frequency domain to attenuate ambient noise 130. In a next preferred step an inverse FFT will be calculated on the now-filtered input signal and, following that, in a next preferred step the blocks will be windowed 140 and summed together to generate an output signal 150.

An embodiment of the instant invention additionally implements a pre- and/or a post ringing filter which might be added to the workflow before generating the final attenuated digital output signal 160. Such a filter might be necessary because, among others, the calculated spectral components in some instances will be narrow-banded, which would result in the transfer function having corresponding narrow-banded segments. These narrow-banded segments could potentially lead to pre- and post ringing which would take the form of unwanted ambient noise.

Continuing with the present embodiment, the pre- and/or post ringing filter(s) will also preferably be implemented in the frequency domain. In most cases this will be a substantially smaller filter order compared to the adaptive speech filter, thus the filter will possesses a higher temporal resolution. The transfer function of the pre- and post ringing filter is calculated by comparing (e.g., by division) the magnitude of the unfiltered input signal with the magnitude of the output signal of the adaptive speech filter. If in specific frequency ranges the output signal contains a substantial higher energy than the unfiltered input signal the instant invention will detect that as a potential pre- or post-ringing of the adaptive speech filter. The transfer function of the pre- and post ringing filter will then be set, in one embodiment, to zero in order to filter out the pre- and post ringing of the adaptive speech filter. After the application of the pre- and post ringing filter the instant invention generates the attenuated output signal 170.

Figure 2:
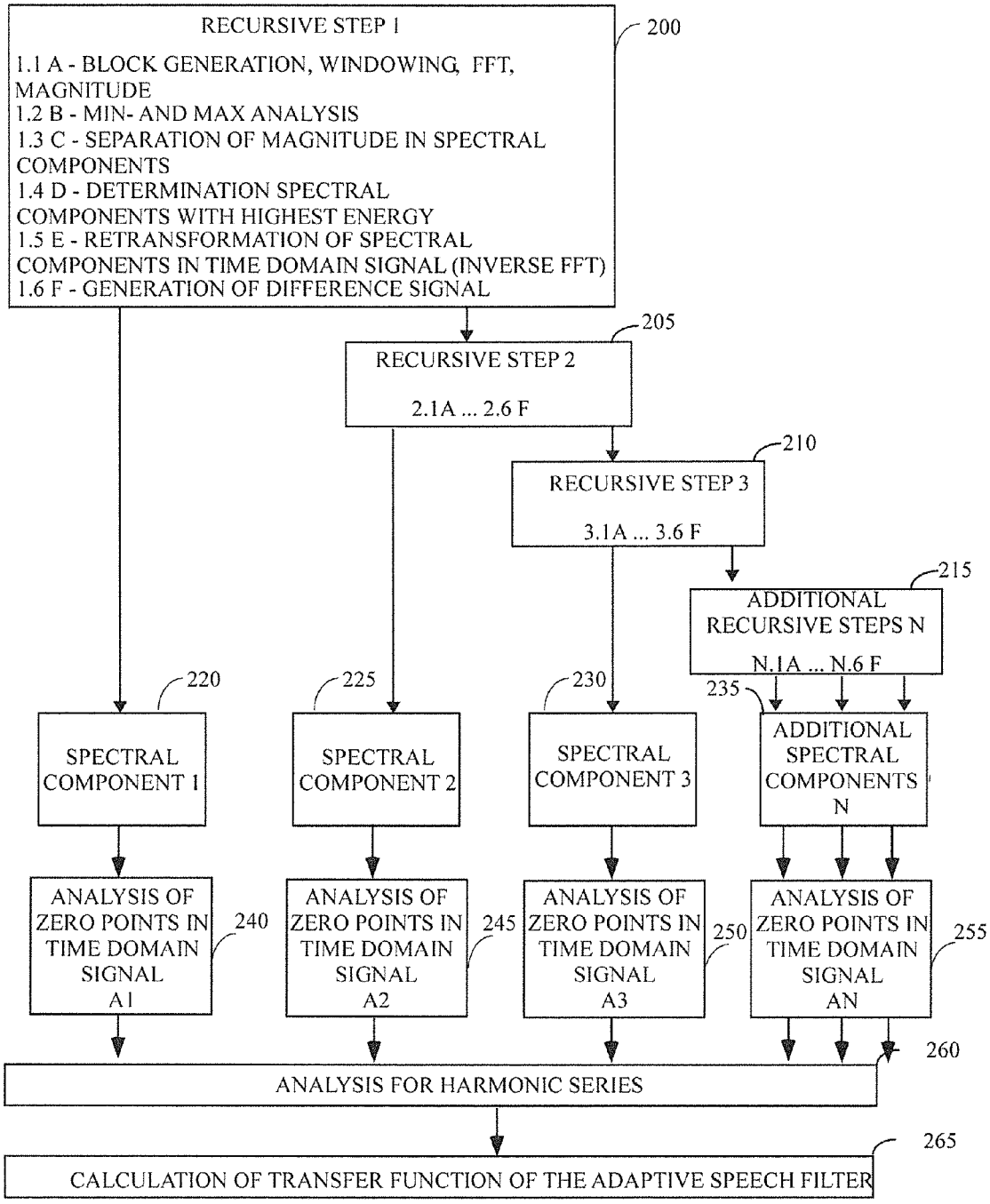
FIG. 2 illustrates the steps of the calculation of the transfer function of an embodiment of the adaptive speech filter.
Figure 3:
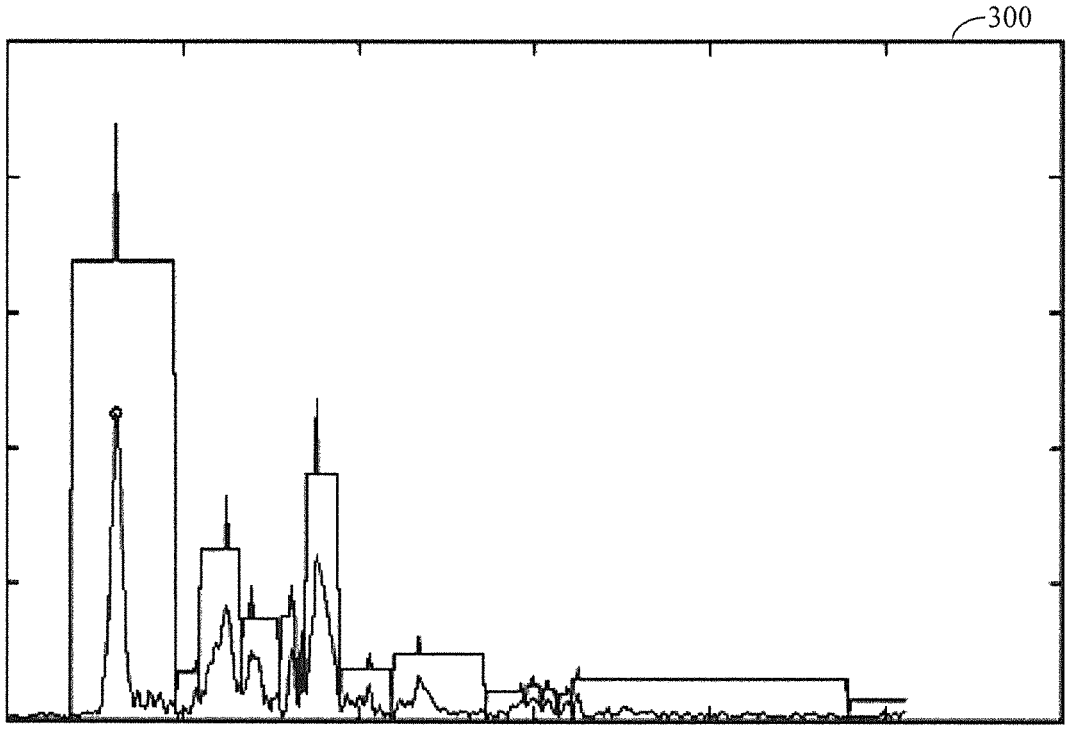
FIG. 3 illustrates a result of the minima, maxima analysis of the input signal for one particular example.

Now turning to the example of FIG. 2, this figure illustrates the steps of the calculation of the transfer function of the adaptive speech filter according to one embodiment. In a first preferred step the input signal will be split up into the spectral bands with the most energy by using a recursive spectral maxima-minima-analysis that looks for the relevant local maxima (peaks) and minima of the spectrum. In some embodiments, a block length of a few hundred or thousand samples (e.g., 4096) depending on the sample rate might be used. In some cases between about 50 and 250 maxima-minima/blocks will be used, more typically between about 10 and 50.

The instant invention will determine for closely lying maxima or minima the locally highest or smallest maxima or minima. In a next preferred step the instant invention will determine the spectral components for relevant maxima and adjacent relevant minima. In case of tonal speech components (vowels), these spectral components contain the harmonics of the speech with the most energy 200.

In the present embodiment, in each step of this recursive process the spectral component with the most energy in the frequency domain will be filtered out and will be available as time domain signal as a result. The difference between the filtered signal and the input signal is then used in the next step of the recursive process 205. A recursive process is utilized because it allows the spectral components with the most energy to overlap to thereby increasing the bandwidth of the filter. This also increases the quality of the analysis because a lower bandwidth might potentially distort the result.

In this embodiment, the recursive process of the instant invention includes a number of steps which are executed recursively. In a first preferred step, the instant invention executes a high resolution spectrum analysis by splitting the signal into individual blocks, windowing and executing of a Fast Fourier Transform within each block, followed by a calculation of the magnitude of the spectrum (short time power density spectrum). In a next preferred step, the magnitude will be analyzed to find maxima-and-minima and the local relevant maxima and minima will be determined.

As a next preferred step the magnitude will be separated into individual spectral components according to the results of the maxima and minima analysis.

Continuing with the current embodiment, in a next preferred step the spectral component with the most energy will be determined and in the next step this determined spectral component will be transformed back into the time domain with an inverse Fourier Transform, thereby providing the spectral component as time domain signal. In the next preferred step a difference signal will be being generated by comparing the input signal and the generated time domain signal—with the difference signal being used as the input signal for the next run-through of the recursive process. These steps create a time domain signal from the spectral components with the most energy and such signal has known spectral properties 220, e.g., the bandwidth and the frequencies with the highest spectral maxima.

The determined spectral components 220 will be, in a next preferred step, analyzed regarding the behavior of the zero points 240. To be more specific and according to the current example, the gradient of the zero point position is calculated in a next preferred step. Additionally, the variance of the scope of the temporal frequency change can also be estimated.

In some embodiments the instant invention will implement a classification of the spectral components according to the following scheme. The variances will be interpreted as follows: if the gradient of the zero point has a relatively high variance value then the spectral component will be classified as noise-like, a relatively low value and it will be classified as tonal. In some embodiments, this determination might be made by comparison with a predetermined value. In some instances a statistical analysis of all of the gradients might be employed. In that case, variances that are more than 1 (or 2, etc.) deviations above the average (or median, etc.) gradient value would be characterized as "high", with variances that are less than, say, 1 (or 2, etc.) standard deviations below the mean being characterized as "low", with the remainder being classified as intermediate.

If the gradient of the zero/null point has a middle/intermediate variance value, then the spectral component will be being classified as tonal part of the speech signal (vowel). If the variance of the gradient of the zero point is very low then the spectral component will be classified as being tonal but likely not a part of the speech signal. Spectral components of this kind are often caused by regular noise sources (for example air condition, engines, etc.).

In a next preferred step and according to another embodiment, the instant invention will determine if these spectral components might be associated with a harmonic sequence 260. In case of success the determined frequencies with the highest spectral maxima of the spectral components are a multiple of a base frequency.

In the next preferred step the transfer function of the adaptive speech filter will be computed 265. For this calculation the results of the analysis regarding harmonic sequences as well as the results of the analysis regarding the behavior of the zero points in the time domain signals of the spectral components will be being used. That being said, the results of these two analyses by themselves might provide erroneous results. For example speech elements may not be determined as such or the speech property is assigned in error to other signal components. With a combination of the results of both analyses the number of erroneous detections is being kept low.

According to an embodiment, the calculation of the filter curve of the adaptive speech filter will be carried as follows. If an association of spectral components to a natural overtone series is detected and more than half of the spectral components assigned to an overtone series have been classified as speech components, all of the spectral components that match with the overtone series will be utilized for the calculation of the adaptive speech filter. The adaptive speech filter is then set to value 1 for all bandwidths of the spectral components. If in the analysis no overtone series is detected and singular spectral components have been classified as speech signals, the adaptive speech filter will be set to value 1 for the bandwidths of these spectral components. In case of fast change of the base frequency, which is typical for speech, the detection of an overtone series sometimes fails. According to this aspect of the invention, an erroneous complete locking of the adaptive speech filter will potentially be prevented.

In summary, the instant invention provides a substantial improvement for both novice and professional users when editing audio recordings and primarily when attenuating ambient noise in speech signals of video recordings. Embodiments of the invention require minimal user interaction, no definition of multiple parameters or definition of noise samples, it is an automatic process that recursively analyzes the input signal. The improved/isolated speech audio from a noisy video recording can then be, for example, integrated back into the audio track of that recording to improve quality of the recorded speech. In other applications, the instant invention might be used to reduce ambient noise in hearing aids, intercoms and telephones, etc. More generally such an approach as that taught herein could be used in instances where the computational power and/or memory available to the device is limited and real-time improvement of the audio for purposes of low-latency speech recognition is desirable.

CONCLUSIONS

Of course, many modifications and extensions could be made to the instant invention by those of ordinary skill in the art. For example in one preferred embodiment the instant invention will provide an automatic mode, which automatically attenuates video recordings in video cameras, therewith providing video recordings with perfect quality audio.

Although the present communication may include alterations to the application or claims, or characterizations of claim scope or referenced art, the inventors do not concede in this application that previously pending claims are not patentable over the cited references. Rather, any alterations or characterizations are being made to facilitate expeditious prosecution of this application.

Applicant reserves the right to pursue at a later data any previously pending or other broader or narrower claims that capture any subject matter supported by the present disclosure, including subject matter found to be specifically disclaimed herein or by any prior prosecution.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is also to be understood that where the claims or specification refer to "a" or "an" element, such reference is not be construed that there is only one of that element.

Where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)—(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

While this invention is susceptible of embodiment in many different forms, there is shown in the drawings, and is herein described in detail, some specific embodiments. It should be understood, however, that the present disclosure is to be considered an exemplification of the principles of the invention and is not intended to limit it to the specific embodiments or algorithms so described. Those of ordinary skill in the art will be able to make various changes and further modifications, apart from those shown or suggested herein, without departing from the spirit of the inventive concept, the scope of which is to be determined by the following claims.

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Still further, additional aspects of the instant invention may be found in one or more appendices attached hereto and/or filed herewith, the disclosures of which are incorporated herein by reference as if fully set out at this point.

Accordingly, readers of this or any parent, child or related prosecution history shall not reasonably infer that the Applicants have made any disclaimers or disavowals of any subject matter supported by the present application.

It should be noted that where reference is made herein to a method comprising two or more defined steps, the defined steps can be carried out in any order or simultaneously (except where context concludes that possibility), and the method can also include one or more other steps which are carried out before any of the defined steps, between two of the defined steps, or after all of the defined steps (except where context concludes that possibility).

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A method of enhancing a speech signal in the presence of noise, comprising:

performing, by computer processing hardware, operations of:

a. reading an audio signal containing said speech signal therein;

b. transforming said audio signal to the frequency domain, thereby forming a transformed audio signal;

c. determining via a recursive spectral analysis a plurality of spectral components in the frequency domain that have a most energy;

d. identifying at least one null point in the time domain associated with each of said plurality of spectral components;

e. determining a gradient of each of said null points;

f. determining a variance of each of said determined gradients;

g. analyzing the variance of each of said determined gradients to assign each of said determined gradients to a category, wherein said gradient with a high variance is classified as noise, wherein said gradient with a middle variance is classified as part of a tonal part of said speech signal, and wherein said gradient with a low variance is classified as a tonal component not a part of said speech signal;

h. determining whether the plurality spectral components with the most energy belong to a harmonic series, wherein frequencies of the plurality spectral components with the most energy are a multiple of a base frequency;

i. calculating a transfer function using said analysis of each variance and said determination of belonging to harmonic series of said plurality of spectral components with the most energy;

j. applying said transfer function to said transformed audio signal, thereby forming a filtered audio signal;

k. inverse transforming said filtered audio signal, thereby forming an enhanced speech signal.

* * * * *